US008220076B2

(12) United States Patent
Chen

(10) Patent No.: US 8,220,076 B2
(45) Date of Patent: Jul. 17, 2012

(54) YOGA GLOVE

(76) Inventor: Yi-Yi Chen, Yuan Lin Chen (TW)

( * ) Notice: Subject to any disclaimer, the term of this patent is extended or adjusted under 35 U.S.C. 154(b) by 120 days.

(21) Appl. No.: 12/905,484

(22) Filed: Oct. 15, 2010

(65) Prior Publication Data

US 2012/0090073 A1 Apr. 19, 2012

(51) Int. Cl.
*A41D 19/00* (2006.01)

(52) U.S. Cl. ..... 2/161.1; 2/159; 2/163; 441/57

(58) Field of Classification Search ..... 2/158, 159, 2/160, 161.1, 161.2, 161.3, 161.5, 161.6, 2/161.7, 161.8, 163, 16, 19, 20; 15/227; 294/25; 441/56, 57, 58; 132/285; 482/44, 482/47, 48, 49; 602/62, 64
See application file for complete search history.

(56) References Cited

U.S. PATENT DOCUMENTS 3,512,194 A * 5/1970 Wolfe ..... 441/57
5,600,849 A * 2/1997 Hu ..... 2/16
6,093,165 A * 7/2000 Estwanik ..... 602/64
7,437,776 B1 * 10/2008 Brown ..... 2/160

* cited by examiner

*Primary Examiner* — Alissa Tompkins
(74) *Attorney, Agent, or Firm* — Hershkovitz & Associates, LLC

(57) ABSTRACT

A yoga glove has a palm section, a back section and a finger section. The palm section has a thumb hole formed through the palm section. An edge of the palm section has a front segment and a rear segment. An extending length of the back section is longer than that of the palm section. An edge of the back section has a front segment and a rear segment. The rear segment of the edge of the back section is connected securely with that of the edge of the palm section. The finger section is crescent shaped. An edge of the finger section is connected securely with the front segments of the palm section and the back section. Therefore, the ergonomically curved yoga glove can match the curved shape of the hand and stay close to the hand.

10 Claims, 8 Drawing Sheets

YOGA GLOVE

BACKGROUND OF THE INVENTION

1. Field of the Invention

The present invention relates to a glove, and more particularly to a yoga glove, which is curved ergonomically to conform to and attach to a hand of a user closely.

2. Description of Related Art

With reference to FIG. 7, a conventional yoga glove 60 in accordance with the prior art is a pad having a middle finger hole 61, a ring finger hole 62 and a wrist hole 63 formed through the pad. The conventional yoga glove 60 further has a thick palm section 64 to provide sufficient friction against a yoga mattress so as to prevent a user wearing the conventional yoga gloves 60 from slipping and being injured.

With reference to FIG. 8, another conventional yoga glove 70 is a thick pad and has a thumb hole, a middle finger strap 71 and a ring finger strap 72. The thumb hole is formed though the thick pad. The middle finger strap 71 and the ring finger strap 72 are mounted securely on the thick pad.

However, gaps between the hand and the conventional yoga gloves 60,70 easily occur when in use because the conventional yoga gloves 60,70 fail to contact closely and ergonomically with the hand. Consequently, the gaps cause slip and the hand easily gets hurt.

To overcome the shortcomings, the present invention tends to provide a yoga glove to mitigate the aforementioned problems.

SUMMARY OF THE INVENTION

The main objective of the invention is to provide a yoga glove, which is curved ergonomically to conform to and attach to a hand of a user closely.

A yoga glove has a palm section, a back section and a finger section. The palm section has a thumb hole formed through the palm section. An edge of the palm section has a front segment and a rear segment. An extending length of the back section is longer than that of the palm section. An edge of the back section has a front segment and a rear segment. The rear segment of the edge of the back section is connected securely with that of the edge of the palm section. The finger section is crescent. An edge of the finger section is connected securely with the front segments of the palm section and the back section. Therefore, the ergonomically curved yoga glove can match the curved shape of the hand and stay close to the hand.

Other objectives, advantages and novel features of the invention will become more apparent with the following detailed description when taken in conjunction with the accompanying drawings.

DETAILED DESCRIPTION OF THE PREFERRED EMBODIMENT

Figure 1:
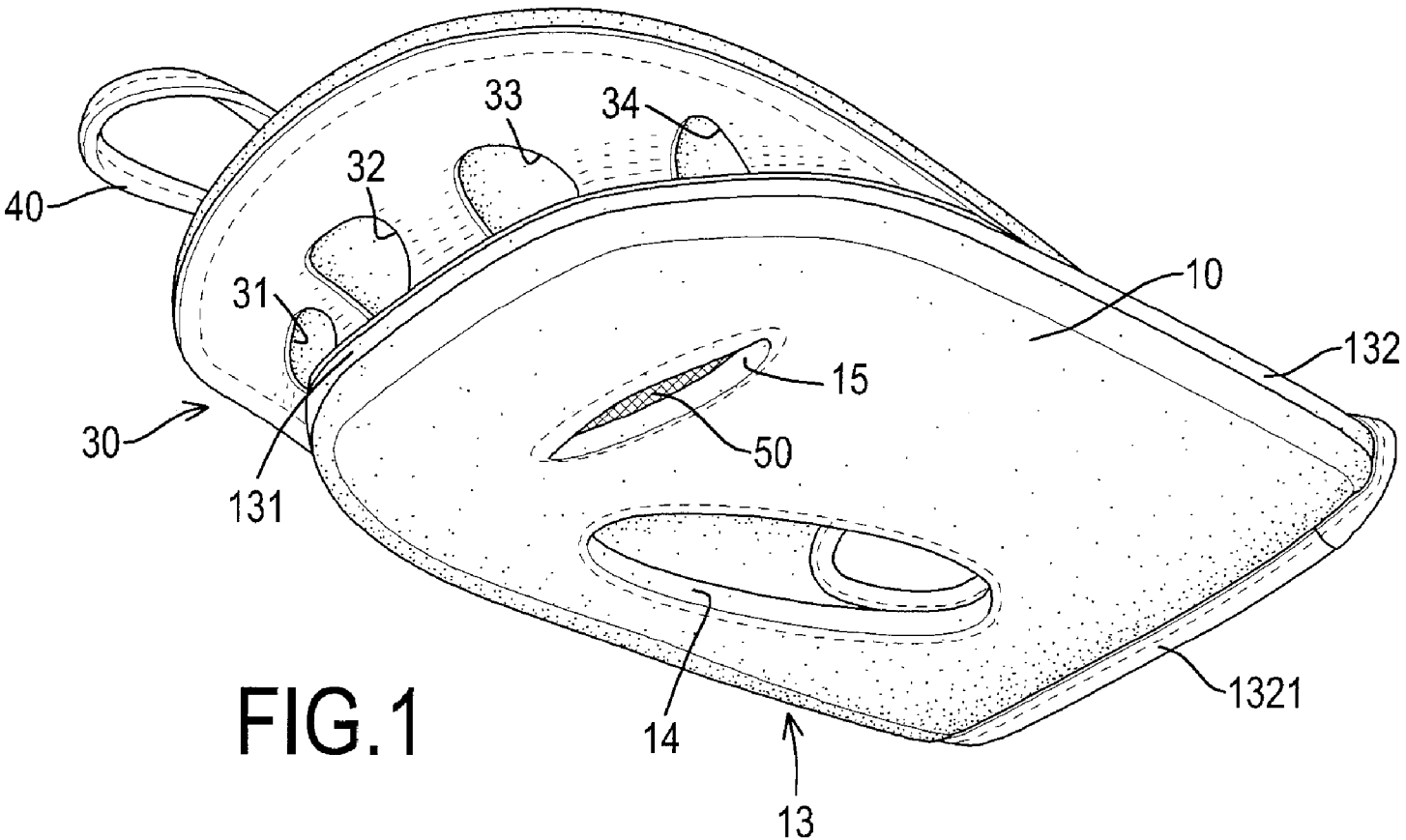
FIG. 1 is a bottom perspective view of a first embodiment of a yoga glove in accordance with the present invention.
Figure 2:
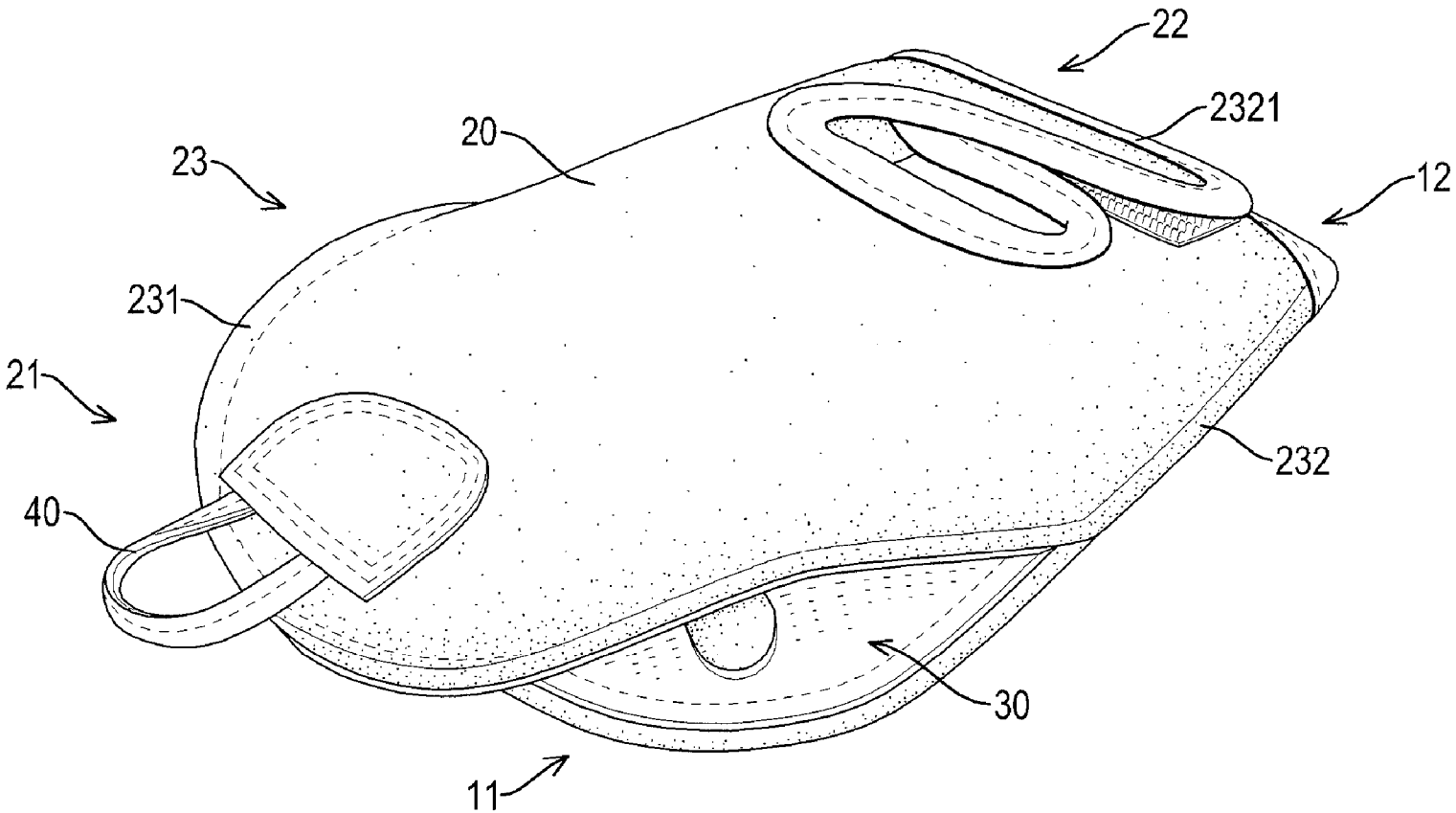
FIG. 2 is a top perspective view of the yoga glove in FIG. 1.
Figure 3:
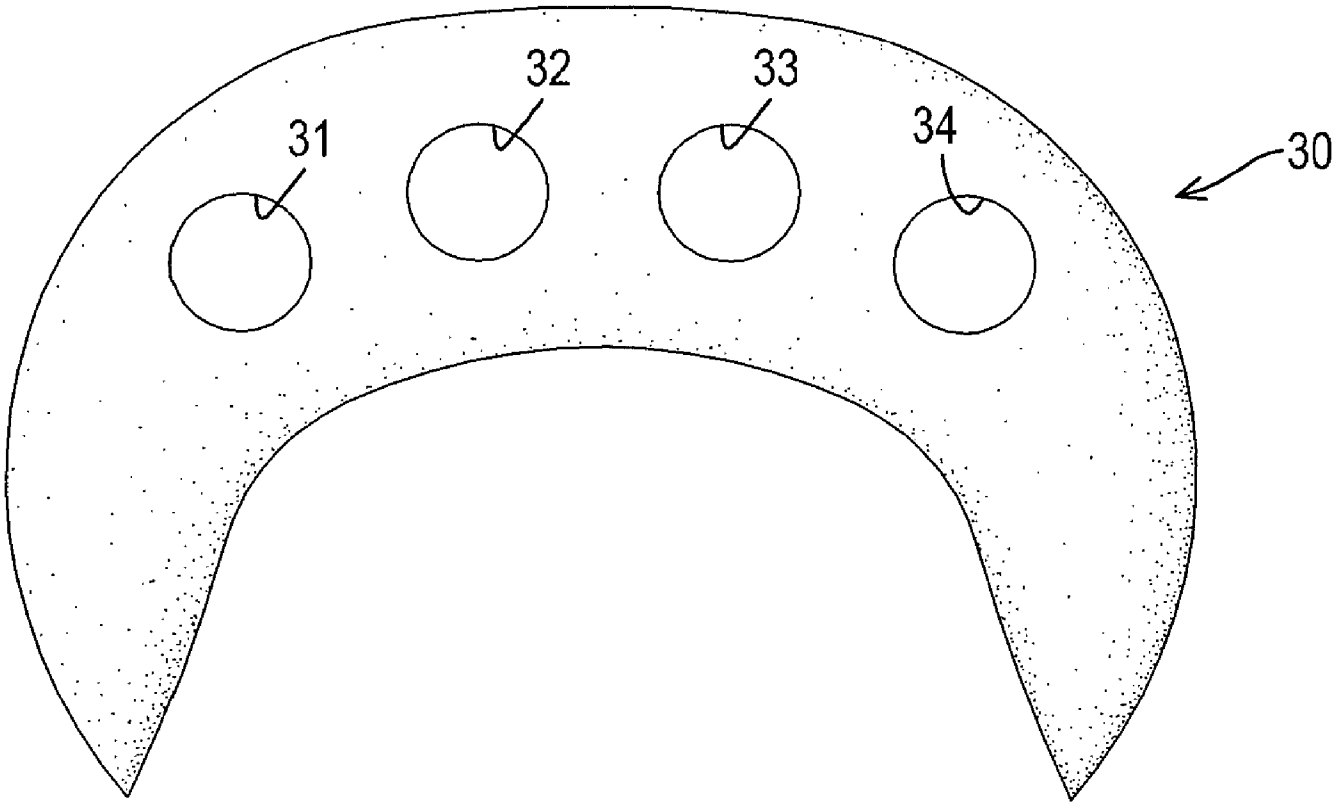
FIG. 3 is an enlarged bottom view of the finger section of the yoga glove in FIG. 1.

With reference to FIGS. 1 to 3, a first embodiment of a yoga glove in accordance with the present invention comprises a palm section 10, a back section 20 and a finger section 30.

The palm section 10 has a front side 11, a rear side 12, an extending length, an edge 13 and a thumb hole 14. The front side 11 of the palm section 10 is opposite to the rear side 12 of the palm section 10. The extending length of the palm section 10 is defined as the maximal length from the rear side 12 to the front side 11 of the palm section 10. The edge 13 of the palm section 10 has a front segment 131 and a rear segment 132. The front segment 131 of the edge 13 of the palm section 10 is located at the front side 11 of the palm section 10. The rear segment 132 of the edge 13 of the palm section 10 is located at the rear side 12 of the palm section 10 and has a wrist area 1321. The thumb hole 14 is formed through the palm section 10. Preferably, the palm section 10 has a contractible opening 15. The contractible opening 15 is eye-shaped, is subject to being opened and closed and is formed through the palm section 10 beside the thumb hole 14. When the palm of the user bends, the contractible opening 15 is closed to prevent the palm section 10 from wrinkling and to attach the hand of the user to the palm section 10 closely and ergonomically.

The back section 20 is connected securely with the palm section 10 and has a front side 21, a rear side 22, an extending length and an edge 23. The front side 21 of the back section 20 is opposite to the rear side 22 of the back section 20 and is adjacent to the front side 11 of the palm section 10. The extending length of the back section 20 is defined as the maximal length from the rear side 22 to the front side 21 of the back section 20 and is longer than the extending length of the palm section 10 to make the yoga glove conform to the hand of the user. The edge 23 of the back section 20 has a front segment 231 and a rear segment 232. The front segment 231 of the edge 23 of the back section 20 is located at the front side 21 of the back section 20. The rear segment 232 of the edge 23 of the back section 20 is located at the rear side 22 of the back section 20 and has a wrist area 2321. The rear segment 232 of the edge 23 of the back section 20 beside the wrist area 2321 of the back section 20 is connected securely with the rear segment 132 of the edge 13 of the palm section 10 beside the wrist area 1321 of the palm section 10 by stitching. The wrist areas 1321,2321 of the palm section 10 and the back section 20 allow the hand of the user to be put in and thus wear the yoga glove.

The finger section 30 is crescent shaped is connected securely with the palm section 10 and the back section 20 and has an edge and multiple finger holes. The edge of the finger section 30 is connected securely with the front segments 131,231 of the palm section 10 and the back section 20 by stitching. The finger holes are formed through the finger section 30. Preferably, the finger holes in sequence have an index finger hole 31, a middle finger hole 32, a ring finger hole 33 and a little finger hole 34.

In the first embodiment of the yoga glove in accordance with the present invention, the palm section 10, the back section 20 and the finger section 30 are three separate pads connected with one another by stitching to form the yoga glove.

Preferably, the palm section 10 has a top surface facing the back section 20 and the back section 20 has a top surface opposite to the palm section 10. The yoga glove further has a loop 40 and a net 50. The loop 40 is implemented by a strip and has two ends and a central segment. The ends of the loop 40 are securely mounted on the top surface of the back section 20. The central segment of the loop 40 is formed between the ends of the loop 40, is arcuate and juts out from the back section 20. The loop 40 enables the yoga glove to be taken off easily from the hand of the user with only one finger.

The net 50 is mounted securely on the top surface of the palm section 10 and is located at the contractible opening 15 to prevent external bodies from entering the yoga glove.

Figure 4:
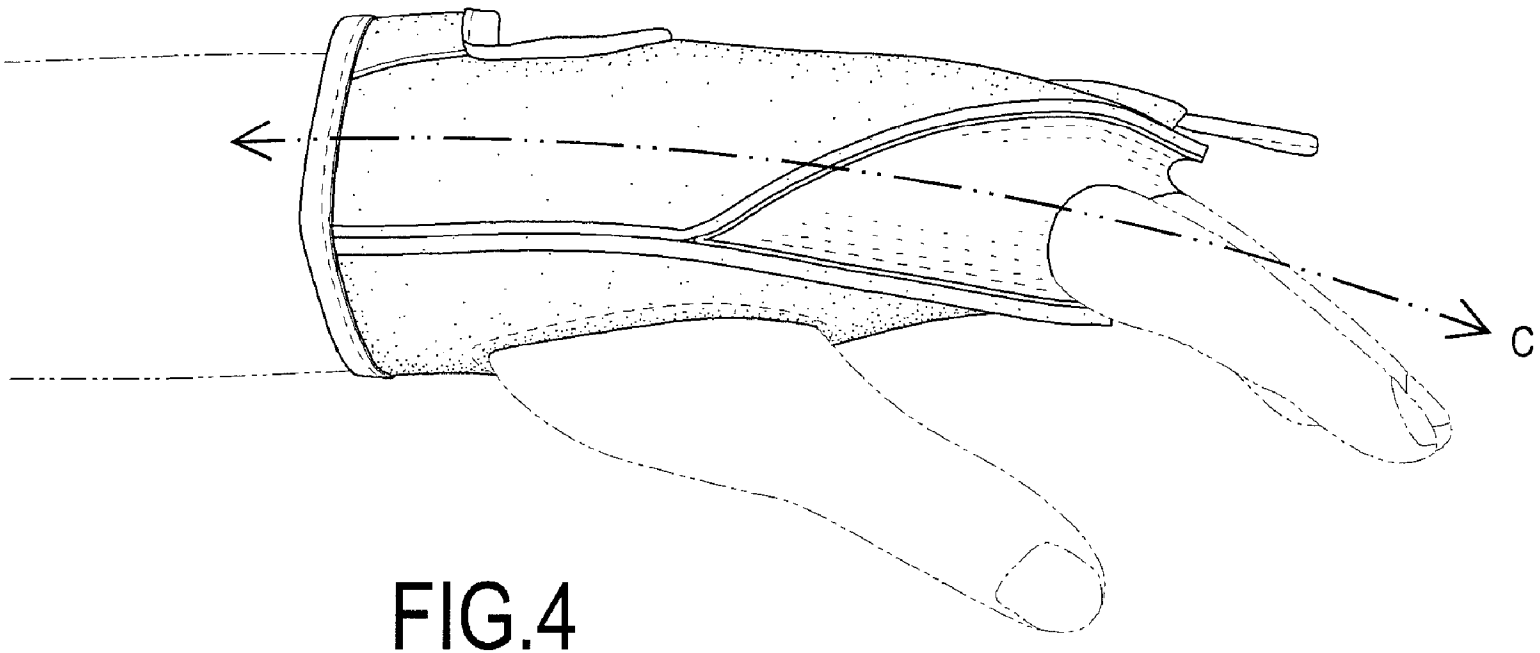
FIG. 4 is an operational side view of the yoga glove in FIG. 1.

With further reference to FIG. 4, FIG. 4 shows that the uncovered fingers beside the thumb are curved along a curve line C while the hand is relaxed. Because the extending length of the back section 20 is longer than that of the palm section 10 and the finger section 30 is crescent, the yoga glove is curved ergonomically and can conform to and attach closely to the hand.

Figure 5:
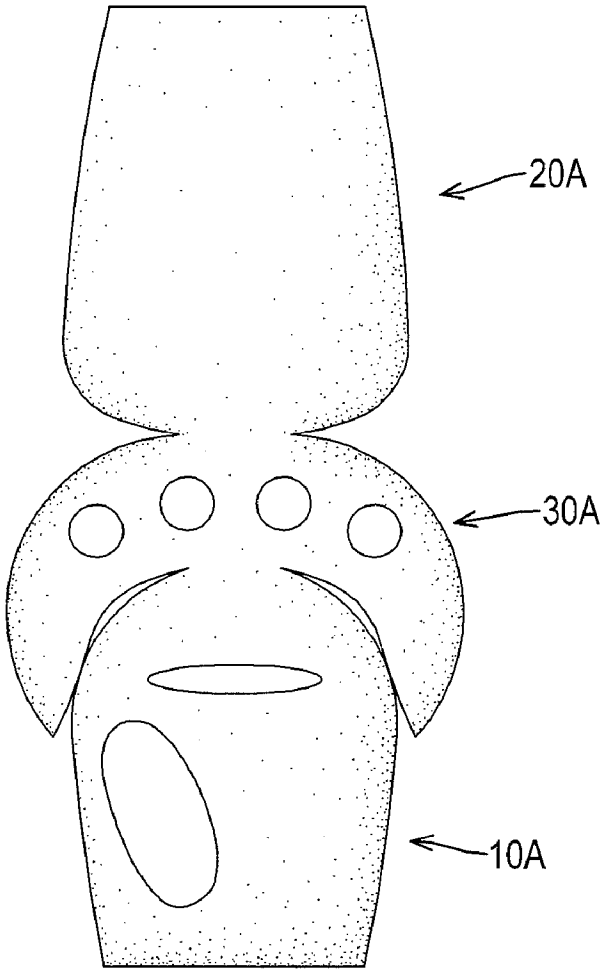
FIG. 5 is a top view of a second embodiment of a yoga glove in accordance with the present invention.

With reference to FIGS. 1 and 5, a second embodiment of the yoga glove is substantially the same as the first embodiment except that the second embodiment of the yoga glove is implemented by a single pad and the finger section 30A is connected integrally with the front segments of the edges of the palm section 10A and the back section 20A. Other sections of the pad beside the integral sections and wrist areas 1321,2321 are stitched to form the second embodiment of the yoga glove.

Figure 6:
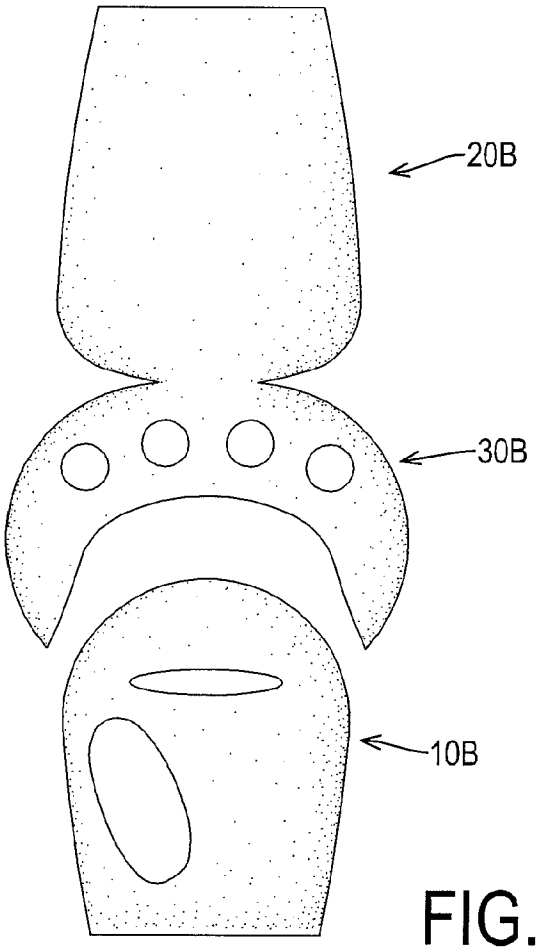
FIG. 6 is a top view of a third embodiment of a yoga glove in accordance with the present invention.
Figure 7:
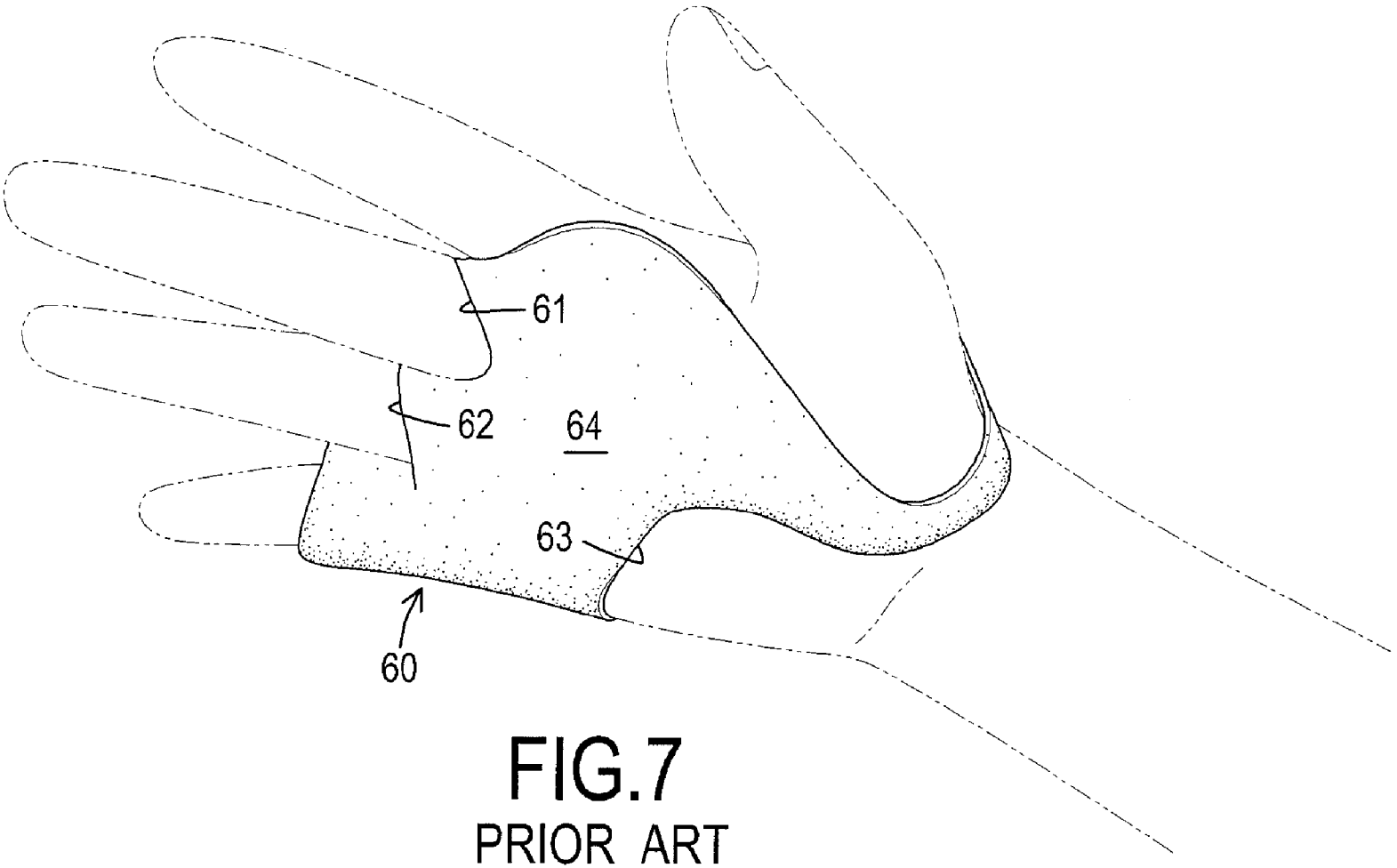
FIG.7 PRIOR ART
FIG. 7 is a perspective bottom view of a conventional yoga glove in accordance with the prior art.
Figure 8:
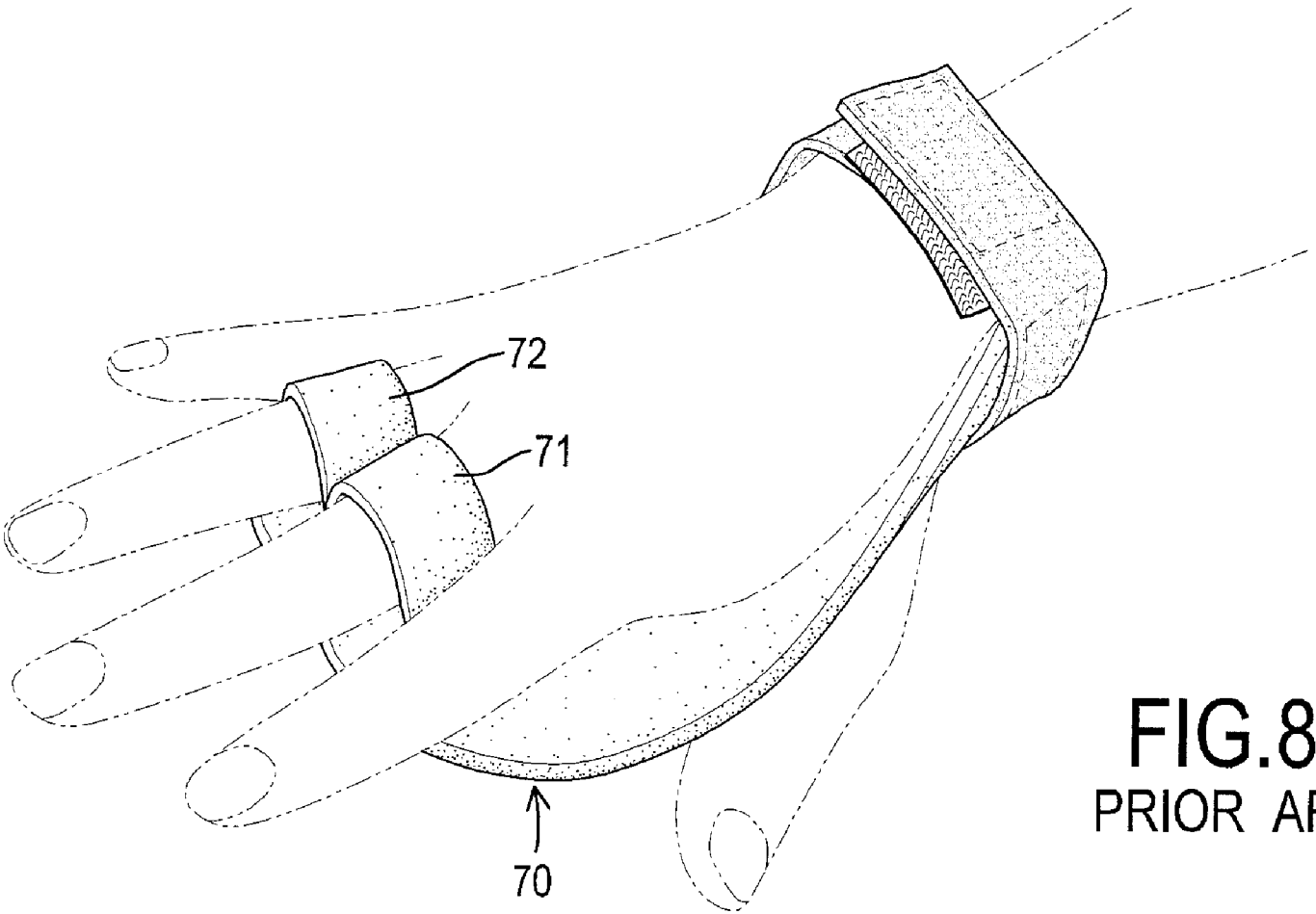
FIG.8 PRIOR ART
FIG. 8 is a perspective top view of another conventional yoga glove in accordance with the prior art.

With further reference to FIG. 6, a third embodiment of the yoga glove is substantially the same as the first embodiment except that the third embodiment of the yoga glove is implemented by two separate pads connected with each other. The palm section 10B is a single pad, and the finger section 30B is connected integrally with the front segment of the edge of the back section 20B. Other sections of the pads beside the integral sections and wrist areas 1321,2321 are stitched to form the third embodiment of the yoga glove.

From the above description, it is noted that the present invention has the following advantages:

1. Excellent Ergonomical Attachment:

The finger section 30, 30A, 30B is crescent and the extending length of the back section 20, 20A, 20B is longer than the extending length of the palm section 10, 10A, 10B, so the ergonomically curved yoga glove can match the curved shape of the hand and stay close to the hand.

2. Easy Take-off from the Hand:

The arcuate central segment of the loop 40 projects from the back section 20, 20A, 20B to enable the yoga glove to be taken off easily from the hand with only one finger, so it is very convenient.

3. Prevention of the Wrinkles:

The contractible opening 15 can be closed to avoid the wrinkling of the palm section 10, 10A, 10B and the palm section 10 can attach closely and ergonomically to the hand.

Even though numerous characteristics and advantages of the present invention have been set forth in the above description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A yoga glove comprising:
- a palm section having
  - a front side;
  - a rear side opposite to the front side of the palm section;
  - an extending length defined as a maximal length from the rear side to the front side of the palm section;
  - an edge having
    - a front segment located at the front side of the palm section; and
    - a rear segment located at the rear side of the palm section and having a wrist area; and
  - a thumb hole formed through the palm section;
- a back section connected securely with the palm section and having
  - a front side adjacent to the front side of the palm section;
  - a rear side opposite to the front side of the back section;
  - an extending length defined as a maximal length from the rear side of the back section to the front side of the back section and being longer than the extending length of the palm section; and
  - an edge having
    - a front segment located at the front side of the back section;
    - a rear segment located at the rear side of the back section and having a wrist area, wherein the rear segment of the edge of the back section beside the wrist area of the back section is connected securely with the rear segment of the edge of the palm section beside the wrist area of the palm section; and
- a crescent shaped finger section connected securely between the palm section and the back section and having
  - an edge connected securely with the front segments of the palm section and the back section; and
  - multiple finger holes formed through the finger section, wherein when said yoga glove is worn, a wearer's fingers protrude through said multiple finger holes, leaving the fingers uncovered;
- said yoga glove being curved ergonomically to conform to and closely attach to a hand of the wearer during use.

2. The yoga glove as claimed in claim 1, wherein the palm section, the back section and the finger section are three separate pads connected with one another to form the yoga glove.

3. The yoga glove as claimed in claim 2, wherein
- the back section has a top surface opposite to the palm section;
- the yoga glove further has a loop implemented by a strip and having
  - two ends mounted securely on the top surface of the back section; and
  - a central segment formed between the ends of the loop, being arcuate and jutting out from the back section.

4. The yoga glove as claimed in claim 1, wherein the yoga glove is implemented by a single pad and the finger section is connected integrally with the front segments of the edges of the palm section and the back section.

5. The yoga glove as claimed in claim 4, wherein
- the back section has a top surface opposite to the palm section;
- the yoga glove further has a loop implemented by a strip and having
  - two ends mounted securely on the top surface of the back section; and
  - a central segment formed between the ends of the loop, being arcuate and jutting out from the back section.

6. The yoga glove as claimed in claim 1, wherein the yoga glove is implemented by two separate pads connected with each other; the palm section is a single pad; and the finger section is connected integrally with the front segment of the edge of the back section.

7. The yoga glove as claimed in claim 6, wherein the back section has a top surface opposite to the palm section;

the yoga glove further has a loop implemented by a strip and having two ends mounted securely on the top surface of the back section; and a central segment formed between the ends of the loop, being arcuate and jutting out from the back section.

8. The yoga glove as claimed in claim 1, wherein the back section has a top surface opposite to the palm section;

the yoga glove further has a loop implemented by a strip and having two ends mounted securely on the top surface of the back section; and a central segment formed between the ends of the loop, being arcuate and jutting out from the back section.

9. The yoga glove as claimed in claim 8, wherein the palm section has a top surface facing the back section;

the palm section has a contractible opening being eye-shaped, subject to being opened and closed, and formed through the palm section beside the thumb hole; and the yoga glove further has a net mounted securely on the top surface of the palm section and located at the contractible opening.

10. The yoga glove as claimed in claim 9, wherein the finger holes in sequence have an index finger hole, a middle finger hole, a ring finger hole and a little finger hole.

* * * * *